US006405964B1

(12) United States Patent
Rüskens et al.

(10) Patent No.: US 6,405,964 B1
(45) Date of Patent: Jun. 18, 2002

(54) INDIVIDUAL SPINDLE DEVICE FOR REWINDING COPS INTO CHEESES

(75) Inventors: Herbert Rüskens, Wegberg; Hans-Peter Ohler, Mönchengladbach; Manfred Marquardt, Mönchengladbach; Marc Küppenbender, Mönchengladbach, all of (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/442,334

(22) Filed: Nov. 17, 1999

(30) Foreign Application Priority Data

Nov. 27, 1998 (DE) ..... 198 54 817

(51) Int. Cl.[7] ..... B65H 54/22; B65H 67/08

(52) U.S. Cl. ..... 242/474.2; 242/474.2; 242/475.6

(58) Field of Search ..... 242/474, 474.2, 242/475.6

(56) References Cited

U.S. PATENT DOCUMENTS 4,801,108 A * 1/1989 Grecksch et al. ..... 242/474.2
4,844,358 A * 7/1989 Kamp ..... 242/474 X
5,394,334 A 2/1995 Simon ..... 364/470
5,484,116 A * 1/1996 Horak et al. ..... 242/475.6
5,651,507 A * 7/1997 Ruskens et al. ..... 242/475.6
5,772,136 A * 6/1998 Gilbos et al. ..... 242/475.6
5,862,660 A * 1/1999 Haasen et al. ..... 242/475.6 X
5,871,168 A * 2/1999 Ruskens et al. ..... 242/474.2
6,123,283 A * 9/2000 Hayashi et al. ..... 242/475.6

FOREIGN PATENT DOCUMENTS

| | | |
|---|---|---|
| CH | 660 872 A5 | 5/1987 |
| DE | 36 24 904 A1 | 1/1988 |
| DE | 39 11 532 A1 | 10/1990 |
| DE | 39 11 798 A1 | 10/1990 |

* cited by examiner

*Primary Examiner*—Michael R. Mansen
*Assistant Examiner*—Minh-Chau Pham
(74) *Attorney, Agent, or Firm*—Kennedy Covington Lobdell & Hickman, LLP

(57) ABSTRACT

In an individual spindle device for rewinding delivery bobbins into cheeses, the winding head thereof is essentially constituted of the same elements and components (11, 14 to 32), and is essentially mounted in the same way as the serially arranged winding heads of a multi-station winding machine.

9 Claims, 2 Drawing Sheets

INDIVIDUAL SPINDLE DEVICE FOR REWINDING COPS INTO CHEESES

FIELD OF THE INVENTION

The present invention relates to an individual spindle device for rewinding delivery bobbins into cheeses, and relates more particularly to such a device which has at least one winding head and a computer, which regulates and/or controls the operation of the winding head.

BACKGROUND OF THE INVENTION

Such individual spindle devices, which can have one or also two winding heads, are independent automatic winders which are used, for example, to process bobbins with yarn remaining on them into cheeses. Such an individual spindle device has its own vacuum supply, a yarn collecting chamber and also its own machine control.

OBJECT AND SUMMARY OF THE INVENTION

It is an object of the invention to provide an improved individual spindle device of the type described above.

This objective is attained in an individual spindle device for rewinding delivery bobbins into cheeses, which basically comprises at least one winding head and a computer for controlling the operation of the winding head, by equipping the winding head with essentially the same elements and components essentially mounted in the same manner as serially arranged winding heads of a multi-station winding machine.

As a rule, winding machines have a plurality of winding heads. If the winding head of an individual spindle device is produced in the same way as the serially arranged winding heads of multi-station winding machines, a clear reduction of the production costs results.

The computer of the winding head of the individual spindle device can also be connected to a central computer via an interface and in this way can be completely controlled and regulated in the same way as a serially arranged winding head of a multi-station winding machine.

An individual spindle device in accordance with the invention can be used as an additional winding head in a multi-station winding machine, i.e. it is connected with this winding machine.

As a result, it is possible to operate the individual spindle device in an identical manner with the winding heads of the multi-station winding machines. For this reason, the cheeses produced on the individual spindle device are comparable in their parameters with the other bobbins, which has a positive effect on the total number of identical cheeses of high quality.

For example, in this manner, it is possible to rewind the rejected cheeses, which mostly occur at the start of a batch. The cheeses then remain with the machine and no extra travel or waiting times are created. After the start of a new batch, this individual spindle device can be removed again and taken to another place of use. In comparison with the use of a winding head permanently installed in a multi-station winding machine, the individual spindle device is autonomous in regard to the supply with delivery bobbins and removal of the finished cheeses.

This is of particular importance since, on the one hand, the delivery bobbins are not to be removed out of the transport circuit of the winding machine and, in the described example, are present in the form of cheeses, while the delivery bobbin circuit of the multi-station winding machine transports cops. Thus, in accordance with the invention, it is easily possible to apply different creeling devices for cops or cheeses at the winding head of the individual spindle device and to replace them later on. This possibility arises already in that the same serially arranged winding heads of multi-station winding machines can be combined, but then permanently, with different creeling devices, wherein they are always uniformly used in the multi-station winding machine.

The finished cheeses, on the other hand, are possibly defective if they are produced from cops which did not unwind correctly and were therefore thrown out. Here a mixture with the regularly produced cheeses of high quality must be prevented.

If the individual spindle device in accordance with the invention is set up independently of a multi-station winding machine, it can be connected to a switchgear cabinet which, besides the electrical supply, contains a computer which corresponds to the central computer of the multi-station winding machine. In this way it is also possible to produce cheeses which correspond to those produced on a multi-station winding machine. By means of this, it is possible, inter alia, to determine reproducible parameters, for example for a fresh batch, without the setting of the entire multi-station winding machine with the resultant larger reject quota being necessary for this.

A separate vacuum generator is not very expensive. Also, connections, possibly to other vacuum systems, are not always available in the required form.

The attachment of the individual spindle device to a running gear assures its mobility.

Further characteristics and advantages of the invention will be understood from the following detailed disclosure of preferred embodiments described with reference to the attached drawings.

DETAILED DESCRIPTION OF THE PREFERRED EMBODIMENTS

Figure 1:
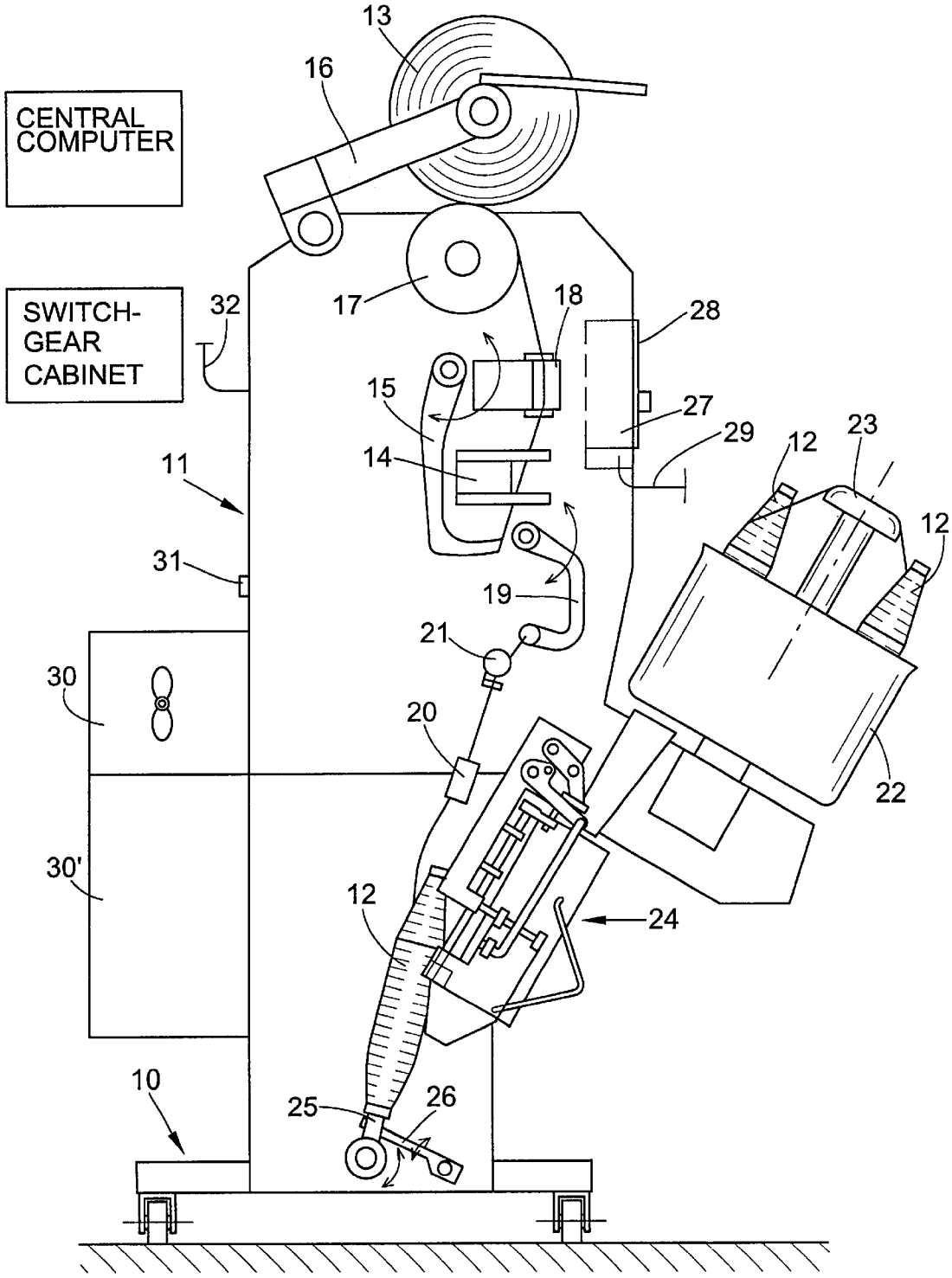
FIG. 1 represents a schematic lateral view of an independent spindle device in accordance with one embodiment of the present invention equipped with a cop creeling delivery device supplied with cops from a round cop magazine.

The individual spindle device, which can be moved form one location to another by means of a running gear 10, has a box-shaped lateral housing 11, in which the drives and attachments for the elements of a winding head (described hereinafter) are housed. The individual spindle device is used for rewinding the yarn length of several cops 12 in succession into a cheese 13. In the process the yarn, which is pulled off each cop 12, passes through a yarn cleaner 18. The yarn cleaner 18 detects the thick and thin places in the yarn and classifies them in accordance with their size and/or length. When still permissible deviations are exceeded, the yarn is cut, so that the winding process is interrupted. The yarn section containing the impermissibly thick or thin places is cut out, after which the two yarn ends are reconnected.

To connect the two yarn ends, the yarn end which trailing from the cheese 13 is picked up by means of a suction gripper 15, which is pivoted to the cheese 13. The cheese 13, which is held in a creel 16, rests on a lap roller 17, e.g., a so-called grooved roller, which is driven by means of a controllable drive motor. To assist in locating the yarn on the cheese 13, the latter is driven against the normal winding direction by the lap roller 17. When the suction gripper 15 has picked up the yarn end, it is pivoted away from the cheese 13, and in the process the aspirated yarn is placed into a splicing device 14 and the yarn cleaner 18. A second suction gripper 19 grasps the leading end of yarn coming from the cop 12, which passes through a yarn guide 20 and a tensioning device 21. The yarn gripper 19 pivots upwardly with the picked-up yarn end from the cop 12 and also inserts it into the splicing device 14. A spliced connection of the two yarn ends is then produced by means of the splicing device 14. The success of splicing the connection, as well as the quality of the spliced connection, are monitored by the yarn cleaner 18, through which the spliced yarn section travels when the winding process is started again.

The individual spindle device in accordance with FIG. 1 has a round magazine 22, which is attached to the lateral housing 11, for example. In a known manner, this round magazine keeps a supply of cops 12 available, with the leading end of the yarn of each of these cops is being placed in a central receiver 23. A cop changer 24 is associated with the round magazine 22, which in a known manner causes the replacement of the cop 12 being rewound, when its yarn supply is depleted, with a fresh cop from the round magazine 22. Only the empty bobbin tube remains of the unwound cop 12, supported on a pivotable mandrel. An ejection lever 26 ejects the empty tube while the cop changer 24 retrieves a cop 12 from the round magazine 22 and places it on the mandrel. In the course of this process, the ready leading end of the yarn of the inserted cop is grasped and inserted into the yarn guide 20 and the yarn tensioner 21 such that it can be grasped by the suction gripper 19. The above-described yarn locating and splicing process is then repeated, i.e., the upper yarn end which has wound onto the cheese 13 is aspirated by the suction gripper 15 and inserted into the yarn cleaner 18 and the splicing device 14. In the same manner, the leading end of the yarn from the fresh cop is inserted into the splicing device 14 by means of the suction gripper 19. The splicing together of the two yarn ends and the restart of the winding process is repeated.

The above described processes are controlled by a computer 27, which also regulates the speed of the drive motor of the lap roller 17. This regulation for example includes the start-up after a cop change as well as the stop after a yarn break. Moreover, the computer 27 can control the drive of the lap roller 17 such that a pattern disruption is maintained when winding the cheese 13.

The individual spindle device furthermore contains a device 30 for generating a vacuum, which can also be controlled by the computer 27, and a yarn collection chamber 30', in which the severed and aspirated yarn ends are collected. The vacuum is particularly needed when operating the suction gripper 15, 19 and for the removal of dust by suction. Pressurized air is needed in the splicing device 18, which preferably is a compressed air splicing device. In a textile mill, compressed air connectors are usually provided for this purpose, which can be connected to an individual spindle device via a connector 31.

An indicator and operating device 28, which is customarily provided at the winding head of a multi-station winding machine, indicates the operating status as well as interruptions and is used for actuating and deactuating the winding head, or respectively the individual spindle device.

The creel 16 is provided with a relief and damping device which is possibly also controlled by the computer 27. Moreover, a cheese diameter measuring device with a shut-off and/or a yarn length measuring device with a shut-off are provided, which can also be controlled by the computer 27.

The above described winding head of the individual spindle device corresponds in its construction and the use of its individual elements to a serially arranged winding head of a multi-station winding machine. This serially arranged winding head contains practically the same elements, wherein the lateral elements or lateral housing 11 are fastened on a profiled element extending through the winding machine in the longitudinal direction and do not have a running gear.

Since the winding head of the individual spindle device corresponds to the greatest extent to the series winding heads of a multi-station winding machine, for example to the AUTOCONER 238/338 of the Schlafhorst company, the individual spindle device can be produced relatively inexpensively, since its components do not require a special production. Furthermore, the individual spindle device can also be used as an additional winding head together with a multi-station winding machine, i.e., it can be connected with this winding machine. The electrical power supply of the individual spindle device is provided from the winding machine by means of an electrical connector 32. The computer 27 can be connected by means of its interface 29 with the central computer of the winding machine, the so-called master computer, so that it operates the winding heads of the individual spindle device with the same operating parameters with which the winding heads of the multi-station winding machine are operated. These serially arranged winding heads customarily each contain a winding head computer. The winding head computers of these winding heads as a whole (or in groups, in case they operate with different batches) are configured by the master computer of the multi-station winding machine. In that case the computer 27 operates corresponding to the winding head computers of the serially arranged winding heads of the winding machine.

If the individual spindle device is not used as an additional winding head in a multi-station winding machine, i.e., is not connected to a multi-station winding machine, it is connected with a switchgear cabinet, not represented, which in particular assures the energy supply via the connector 32 and contains a computer of the type of the central computer of the winding machine, which is connected via an interface 29 of the individual spindle device. Appropriate reference data and work programs can be loaded into the computer 27 by this means, and the control of the yarn cleaner 18 can take place. For this purpose, the switchgear cabinet also should contain the input means corresponding to the master computer of the winding machine. Several winding heads in the form of otherwise autonomous individual spindle devices can be connected to it, the same as to the master computer.

Figure 2:
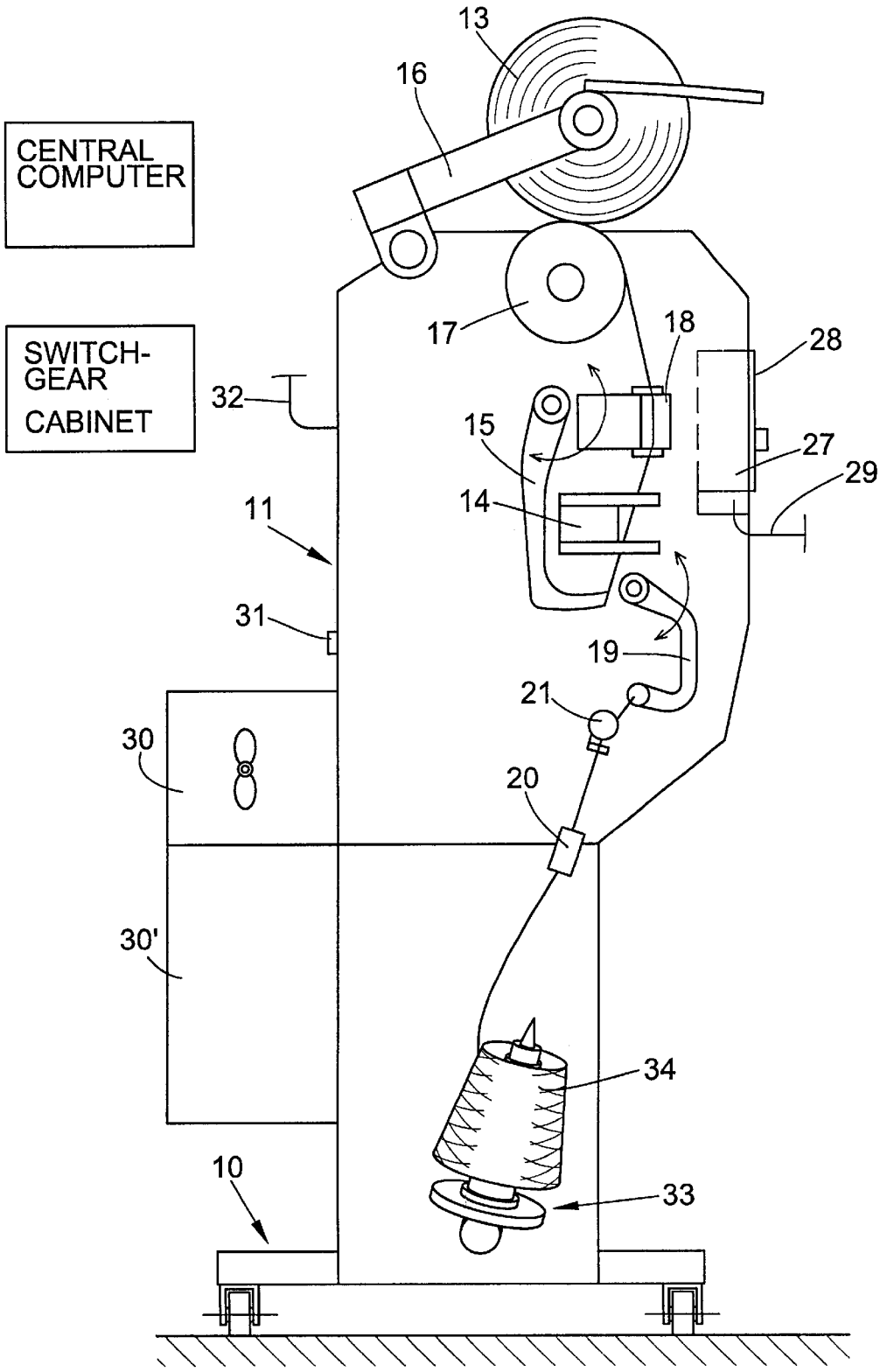
FIG. 2 represents a schematic lateral view of an independent spindle device in accordance with another embodiment of the present invention equipped with a single creeling delivery device, in particular for feeding yarn from cheeses.

Regardless of whether the individual spindle device is connected with a winding machine or a switchgear cabinet, it is possible to attach different creeling devices for different delivery bobbins on the frame element 11. Thus, in the already described FIG. 1, a mandrel 25 for cops 12 is provided, which is supplied by a round magazine 22. Alternatively, in FIG. 2 an individual creeling device 33 for a cheese 34 is provided, which is separately supplied with bobbins, since cheeses have a clearly longer unwinding time in comparison with cops.

However, still other known creeling systems for various bobbin formats are also conceivable.

Moreover, it is possible, but with additional outlay of expense, to connect the central computer fixedly with the individual spindle device. In that case it is completely autonomous.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A yarn winding machine comprising (a) a frame (11), (b) only a single winding head supported on the frame, the winding head having:

(i) a single location for winding a cheese (13), (ii) a single yarn guiding and handling arrangement for delivering a yarn to the cheese winding location and comprising a yarn defect cleaning device (18) and a yarn end joining device (14), and (iii) drive devices therefor, (c) the single winding head being structurally identical to a plurality of structurally identical winding heads of a multi-station winding apparatus, (d) a coupling arrangement (29, 32) associated with the frame for selective operative connection of the winding head with a separate energy supply and control unit external to the winding machine, and (e) wheeled running gear (10) supporting the frame for traveling transportation of the winding machine to and from differing operating positions, including an operating position connected by the coupling arrangement with the multi-station winding apparatus.

2. A yarn winding machine in accordance with claim 1, wherein the coupling arrangement comprises a computer (27) supported by the housing and including an interface (29) substantially identical to an interface of a winding head computer of the multi-station winding apparatus for connection with another computer.

3. A yarn winding machine in accordance with claim 2, characterized in that the another computer comprises a central computer installed in the multi-station winding apparatus.

4. A yarn winding machine in accordance with claim 2, characterized in that the another computer is housed in a separate switchgear cabinet for controlling one or several of the yarn winding machines.

5. A yarn winding machine in accordance with claim 1, characterized further by a vacuum generator (30) associated with the single winding head.

6. A yarn winding machine in accordance with claim 1, characterized further by varied creeling devices (25,33) for accepting different delivery bobbins (12,34) selectively attachable to the frame (11) of the winding head.

7. A yarn winding machine according to claim 1, wherein the separate energy supply and control unit is part of the multi-station winding apparatus.

8. A yarn winding machine according to claim 1, wherein a separate switchgear cabinet comprises the separate energy supply and control unit.

9. A yarn winding machine comprising (a) a frame (11), (b) no greater than two winding heads supported on the frame, each winding head having:

(i) a single location for winding a cheese (13), (ii) a single yarn guiding and handling arrangement for delivering a yarn to the cheese winding location and comprising a yarn defect cleaning device (18) and a yarn end joining device (14), and (iii) drive devices therefor, (c) each winding head being structurally identical to a plurality of structurally identical winding heads of a multi-station winding apparatus, (d) a coupling arrangement (27, 32) associated with the frame for selective operative connection of each winding head with a separate energy supply and control unit external to the winding machine, and (e) wheeled running gear (10) supporting the frame for traveling transportation of the winding machine to and from differing operating position, including an operating position connected by the coupling arrangement with the multi-station winding apparatus.

* * * * *